US007115188B2

(12) United States Patent
Lilburn

(10) Patent No.: US 7,115,188 B2
(45) Date of Patent: Oct. 3, 2006

(54) PROCESS AND APPARATUS FOR MONITORING DEWATERING IN A WET SECTION OF A PAPER MACHINE

(75) Inventor: Andrew Lilburn, Raleigh, NC (US)

(73) Assignee: Voith Paper Patent GmbH, Heidenheim (DE)

( * ) Notice: Subject to any disclaimer, the term of this patent is extended or adjusted under 35 U.S.C. 154(b) by 621 days.

(21) Appl. No.: 10/050,167

(22) Filed: Jan. 18, 2002

(65) Prior Publication Data

US 2003/0136535 A1 Jul. 24, 2003

(51) Int. Cl.
*D21F 11/00* (2006.01)
*D21F 13/00* (2006.01)

(52) U.S. Cl. ..... 162/198; 162/263; 162/253; 162/252; 162/360.2; 162/49; 700/127

(58) Field of Classification Search ..... 162/360.2, 162/198, 252, 253, 49, 263; 700/127
See application file for complete search history.

(56) References Cited

U.S. PATENT DOCUMENTS 3,185,617 A * 5/1965 Justus ..... 162/274
3,268,390 A * 8/1966 Ely ..... 162/306
3,655,980 A 4/1972 Bossen
3,724,957 A 4/1973 Tamate et al.
3,860,168 A 1/1975 Byrd et al.
4,752,356 A 6/1988 Taggert et al.
5,093,795 A 3/1992 Lewis
5,262,955 A 11/1993 Lewis
5,286,348 A 2/1994 Perin
5,330,621 A 7/1994 Visuri et al.

FOREIGN PATENT DOCUMENTS

WO 00/08462 2/2000

* cited by examiner

*Primary Examiner*—Mark Halpern
(74) *Attorney, Agent, or Firm*—Greenblum & Bernstein, P.L.C.

(57) ABSTRACT

Process and apparatus for monitoring dewatering in a wet end section of a web production machine. The process includes measuring water flowing into the wet end section, measuring water flowing out of the wet end section, measuring conductivity of the wet web entering the wet end section, measuring conductivity of the water flowing into wet end section, measuring conductivity of water flowing out of the wet end section, and determining a water balance from the measured quantities, which is indicative of dewatering in the wet end. The apparatus is arranged to perform the process.

33 Claims, 4 Drawing Sheets

PROCESS AND APPARATUS FOR MONITORING DEWATERING IN A WET SECTION OF A PAPER MACHINE

BACKGROUND OF THE INVENTION

1. Field of the Invention

The present invention is directed to a process and apparatus for monitoring dewatering in a wet end section of a paper machine, in particular in the press section.

2. Discussion of Background Information

In the wet end section of a paper machine, e.g., in the press section, the wet fibre web is pressed between cylindrical rolls. Press fabrics are passed through press nips formed by these cylindrical rolls with the web to cushion the web and to absorb water squeezed from the web. A series of press nips acts upon the web before it leaves the press section to pass to the dryer section of the paper machine.

The water removed from the paper web is partly absorbed by the press fabrics, which are generally arranged on each face of the paper web to sandwich the web, and the remainder is expelled mechanically from each nip of the press section to be caught in collection troughs, or through vacuum backed ventilated rolls. After leaving the press section the press fabric is treated with additional water by showers to clean, condition and lubricate the fabric. The press fabric is then passed over a vacuum area formed by one or more suction devices, e.g., Uhle boxes, which causes water to migrate to the fabric surface for mechanical removal.

The press section is intended to remove the maximum amount of water without compromising the quality of the paper web produced. The amount of water removed is dependent on nip pressure, water absorption capacity of the press fabrics, and the ability of the press rolls to carry water away from the press nip to collection troughs.

The water absorption capacity of the press fabric depends upon the water volume received from the cleaning sprays, the water removal capacity of the vacuum dewatering devices, the cleanliness of the press fabric and the design characteristics of the press fabric.

At present it is not possible to know the dryness of the paper web as it leaves each press nip or as it finally enters the dryer section. To measure the water content directly requires that the sheet be broken, and the machine be out of use for a costly period of downtime. Indirect measurement of the water content of the web requires that a material balance be determined by measuring water flow from the collection troughs, vacuum dewatering devices, and the water content remaining in the press fabric. The latter can be measured using a microwave based moisture meter which is manually pressed into the fabric and moved across the width of the machine. In addition the water content entering press section must be measured or assumed.

Because the carrying out of these material balance procedures require expertise and time, they are not normally carried out except under special circumstances. Consequently, during the normal running of the paper machine there are many unknowns which prevent optimization of the water removal process.

The unknowns include, e.g., the effect of press loading on distribution of water flow into the fabric and into the collection trough and overall removal; the effect of the fabric shower flow on the distribution of water flow and overall water removed; the effect of upstream conditions on water removed in the press section; the effect of the paper basis weight on water removal in the press section; the effect of fabric cleanliness on water flow and overall removal; the effect of vacuum levels, dwell time and airflow on water flow and overall removal; the effect of needle jet shower pressures on water flow and overall removal; the effect of roll cover hardness on water flow and overall removal; and the effect of press fabric design on water flow and overall removal.

U.S. Pat. No. 3,655,980 proposes measuring the drainage rate from slurry along the length of a forming wire, using a radiation source and radiation detectors. In U.S. Pat. No. 3,724,957, the concentration of an optically active substance is measured using photoelectric detectors to determine the concentration of pulp and clay in a papermaking slurry, while U.S. Pat. No. 3,860,168 uses a nucleonic detector to monitor the weight of paper sheet. Moisture sensors are used in, e.g., U.S. Pat. Nos. 5,093,795 and 5,262,955, which measure the moisture content profile and adjust the moisture content by adding water or steam to the web, and in, e.g., U.S. Pat. No. 5,286,348, which uses an infra red sensor on the web emerging from the last dryer in a papermaking machine.

U.S. Pat. No. 4,752,356 discloses sampling the slurry at the wet end of a paper machine to determine the total organic carbon present as a measure of the requirement for cationic additive materials to neutralize anionic contaminants in the papermaking process, and U.S. Pat. No. 5,330,621 discloses continuously analyzing cellulose pulp slurry to determine elemental constituents, by gamma neutron activation analysis or carbon content analysis. The measurements are not made on the paper machine during a papermaking process.

However, none of these measurement methods meet the requirements for continuous material balance monitoring during paper machine operation.

International Publication No. WO 00/08462, the disclosure of which is expressly incorporated by reference herein in its entirety, discloses a process and apparatus for monitoring water balance in a paper machine in which the electrical conductivity of the felts entering the press section are compared to the electrical conductivity of the paper web emerging from the press section. However, in this system, wet web (paper volume) flow to the press section is calculated while the solids content of wet web and its conductivity in front of the press is unknown. Further, as the felts are not included in the solids balance, they only apply to the stationary condition.

SUMMARY OF THE INVENTION

The instant invention provides a process and apparatus for monitoring the dewatering process in the wet end section, and preferably the press section, of a paper machine during operation of the paper machine.

According to the invention, solid content of the paper web leaving the press section is determined. Moreover, a cross-direction profile of the solid content of the paper web leaving the press section is determined.

Moreover, the instant invention determines the fate of sheet water and/or shower water, preferably sectionally in the cross-direction.

The present invention utilizes the water balance of the press section to determine web consistency/dryness after the press. In order to determine the water balance, the water flow rate (in gallons per minute (gpm)) into ($W_{in}$) and out of (Wout) the press section are measured, e.g., with flow meters, such as inductive flow meters, weir overflow boxes, etc., as is the conductivity into ($C_{in}$) and out of ($C_{out}$) the press section (in micro mhos (μ℧ )).

In measuring water flow into the press section, the water of the wet web can be determined, e.g., by gamma gauge and calculation, and the shower water is measured. The water out of the press section is measured from water flow into the felt suction boxes, e.g., Uhle boxes, as is the press water from the press. The conductivity into the press section is measured from the conductivity of the wet web, which is essentially the same as the headbox conductivity, and the conductivity of the shower water, which can be determined by, e.g., an in-line meter. The conductivity out of the press section is measured from the conductivity of the water of the felt suction boxes, e.g., Uhle boxes, which can be determined by, e.g., an in-line meter, and from the conductivity of the press water, which can also be determined by, e.g., an in-line meter.

The instant invention utilizes the finding that conductivity versus dissolved solids is linear at paper making pHs. As such, conductivity×flow is additive, i.e., a specific mixture of two different conductivities has only one possible conductivity.

Moreover, adding conductivity to the press section material balance allows for the determination of the origin and fate of all water in the press section.

Thus, utilizing the above-noted flow rates and conductivities, water flow (Win)×conductivity (Cin) into the press section is determined, as is water flow (Wout)×conductivity (Cout) out of the press section. Moreover, these calculations can be made after each nip in the press section.

Accordingly, the instant invention utilizes the following balancing equations, whereby the exit sheet flow and exit sheet dryness are determined:

Calculated shower water in flow=Uhle flow×[(sheet conductivity−Uhle conductivity)/(sheet conductivity−shower conductivity)]; (1)

Calculated shower water in pan flow=Uhle flow×[(sheet conductivity−pan conductivity)/(sheet conductivity−shower conductivity)]; (2)

Sheet water in Uhle flow=Uhle box total−shower flow in Uhle box; (3)

Sheet flow in pan flow=pan total−shower flow in pan; (4)

Exit sheet flow (gpm)=(inlet sheet gpm+shower gpm)−(press pan+Uhle box) gpm−(shower measured gpm−shower calculated gpm); and (5)

Exit sheet dryness=inlet fiber mass/(exit mass of water+fiber). (6)

In accordance with the features of the instant invention, the fate of shower water and/or sheet water can also be determined. In this regard, the fate of the water in the z-direction can be determined, as well as to compare the sectional conductivity of the felts after the nip in the cross direction. The instant invention utilizes a sectional Uhle box or a plurality of Uhle boxes arranged in the cross-direction and measures the conductivity of the removed water in these Uhle sections (boxes) to calculates components (sheet and shower water) contained in the removed water at each location. In this manner, a cross-direction profile of the water removal can be obtained. It may be preferable to arranged at least three Uhle sections or boxes in the cross-direction in order to divide the web into three sections, i.e., two edge portions, e.g., about 1 m wide, and a middle portion.

Moreover, in addition to sectionalized Uhle boxes, the apparatus can include sectionalized suction rolls, sectionalized press pans to facilitate the water removal cross-direction profile determination. Further, a bank of cross-direction conductivity meters can be installed in each Uhle box and/or press pan. In this way, if shower water removal is constant, the sheet/shower ratio variation across the fabric reflects the cross-direction sheet water removal by fabric. Moreover, if sheet water removal remains constant, the sheet/shower ratio variation reflects the cross-direction shower water application variation.

According to the instant invention, the cross-direction water removal profile can be utilized to condition the felt and/or indicate when replacement of the felt is necessary. In this regard, for a given grade of production, the largest variation in the press section is the condition of the press felts. For a given felt design, the performance of the felt changes over its lifetime, e.g., while the removal of sheet water in a nip by a new felt may be merely a process of transferring the sheet water to the felt until removal at the Uhle boxes, as the felt ages, the total amount and proportion removed by the Uhle boxes generally decreases in a characteristic way. Thus, the sheet water removal cross-profile can be utilized to determine a rate of felt deterioration, thereby indicating that a chemical cleaning of the felt is required to improve the felt performance. Moreover, as excessive sheet water removal can be an indication of excessive nip press, which can result in the unintended crushing of the sheet, the sheet water removal cross-profile can be utilized to indicate the need for cleaning the felt, reducing the nip loading, or reducing shower water flow, thereby preventing operational problems due to machine breaks.

Moreover, by analyzing the cross-directional water removal profile through the process and apparatus of the instant invention, many advantages are available to the user to optimize the web production process. For example, specific felt designs and multiple felt designs can be optimized. Further, it is possible to optimize the roll cover or sleeve hardness or venting. With regard to the felt, cleaning, shower flows, chemical cleaning or conditioning, applied vacuum can be optimized, as well as the Uhle box design. The instant invention also enables a felt startup strategy to minimize initial runnability problem, and the ability to identify key control variables, e.g., sheet/shower water ratio to optimize water removal.

The cross-direction profile of sheet/shower water removal ratio in the Uhle box can be used to determine the cross-direction water removal in the felt or the distribution of shower water across the felt.

The process can also include supplying a suspension from a headbox to form the wet web. The determined conductivity of the wet web entering the wet section corresponds to the conductivity of the suspension in the headbox.

Therefore, the instant invention enables one to maintain an optimum compromise between quality issues such as bulk/dryness/bone dry weight and to maintain an optimum compromise between quality and productivity issues.

The present invention is directed to a process for monitoring dewatering in a wet end section of a web production machine. The process includes measuring water flowing into the wet end section, measuring water flowing out of the wet end section, measuring conductivity of the wet web entering the wet end section, measuring conductivity of the water flowing into wet end section, measuring conductivity of water flowing out of the wet end section, and determining a water balance from the measured quantities, which is indicative of dewatering in the wet end.

In acccordance with a feature of the instant invention, the water balance can be determined from the equation water flow (Win)×conductivity (Cin)=water flow (Wout)×conductivity (Cout). Further, the water balance may be determined after each press in the wet section.

Moreover, the dewatering can be monitored in a press section, and the press section may include at least one press, at least one felt, at least one suction box, at least one shower nozzle, and at least one press pan. The process can further include collecting water pressed out in the at least one press in the at least one press pan, collecting water from the at least one felt with the at least one suction box, wherein the collected water is water flowing out of the press section, spraying the at least one felt with water from the at least one shower nozzle, wherein the sprayed water is water flowing into the press section, and determining the water balance of the press section, which is indicative of the dewatering in the press section.

Moreover, the water balance in the press section can be determined by the above-noted balance equations, the Uhle flow and conductivity is from the water collected at least one suction box. The press section can include a plurality of presses, and the water balance may be determined after each press. Further, the process can include measuring the conductivity of the material suspension in the headbox as the conductivity of the web flowing into the press section. At least one of the collected water from the press pan and the collected water from the suction box may be collected sectionally in the cross-direction. The conductivity of the at least one sectionally collected water may be sectionally determined.

Still further, the press section can include a plurality of presses, and the water balance is determined sectionally after each press to create a cross-direction water removal profile. The press section may include at least one control unit to monitor the cross-direction water removal profile and selectively adjust parameters to optimize felt life. The selectively adjustable parameters can include vacuum strength, suction box slot size, nip loading in the press, shower flow. The process can also include measuring the conductivity of the material suspension in the headbox as the conductivity of the web flowing into the press section. The conductivity and water flow of the web entering a subsequent press may be calculated from the water balance.

The collected water from the press pan and the collected water from the suction box may be collected sectionally in the cross-direction, and the conductivity of the sectionally collected water is sectionally determined. A cross-direction profile of the sheet/shower water ratio in the at least one suction box can be calculated to determine the cross-direction sheet water removal into the felt.

Moreover, the above-noted equations can be utilized to determine the water balance in the wet end section.

The selectively adjustable parameters can include vacuum strength, suction box slot size, nip loading in the press, and shower flow.

According to still another feature of the invention, the equation conductivity×water flow is additive.

In accordance with still another feature of the present invention, at papermaking pH, i.e., the absence of free mineral acidity or hydroxide alkalinity, conductivity versus dissolved solids is linear.

Moreover, the process can include supplying a suspension from a headbox to form the wet web. The determined conductivity of the wet web entering the wet section corresponds to the conductivity of the suspension in the headbox.

The present invention is directed to an apparatus for monitoring dewatering in a wet end section of a web production machine. The apparatus includes a device measuring water flowing into the wet end section, a device for measuring water flowing out of the wet end section, a device for determining conductivity of the wet web entering the wet end section, a device for measuring conductivity of the water flowing into wet end section, a device for measuring conductivity of water flowing out of the wet end section, and a processing device for determining a water balance from quantities measured by the measuring devices, wherein the determined water balance is indicative of dewatering in the wet end.

In accordance with another feature of the invention, the wet end section may include a press section having at least one press, at least one felt, at least one suction box arranged to suction said at least one felt, at least one shower nozzle arranged to spray said at least one felt, and at least one press pan arranged to collect water removed by the at least one press. The water balance in the press section can be determined by the above-noted balance equations.

In accordance with a further feature of the instant invention, the press section may further include a plurality of presses, and the water balance may be determined after each press. The conductivity of the material suspension in a headbox can be measured as the conductivity of the web flowing into the press section. At least one of the press pan and the suction box can be sectionally divided in the cross-direction to sectionally collect the water. The conductivity of the at least one sectionally collected water may be sectionally determined.

Moreover, the press section can further include a plurality of presses, and the water balance may be determined sectionally after each press to create a cross-direction water removal profile. The press section can further include at least one control unit to monitor the cross-direction water removal profile and selectively adjust parameters to optimize felt life. The at least one control unit is arranged to selectively adjust at least one of vacuum strength, suction box slot size, nip loading in the press, shower flow. The conductivity of the material suspension in the headbox is measured as the conductivity of the web flowing into the press section, and the conductivity and water flow of the web entering a subsequent press can be calculated from the water balance.

The press pan and the suction box may be sectionally divided in the cross-direction to sectionally collect the water, and the conductivity of the sectionally collected water can be sectionally determined. A cross-direction profile of the sheet/shower water ratio in the at least one suction box can be calculated to determine the cross-direction sheet water removal into the felt.

In accordance with still yet another feature of the present invention, the conductivity determining device can be positioned to determine the conductivity of a suspension in a headbox. The headbox supplies the suspension to form the wet web.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
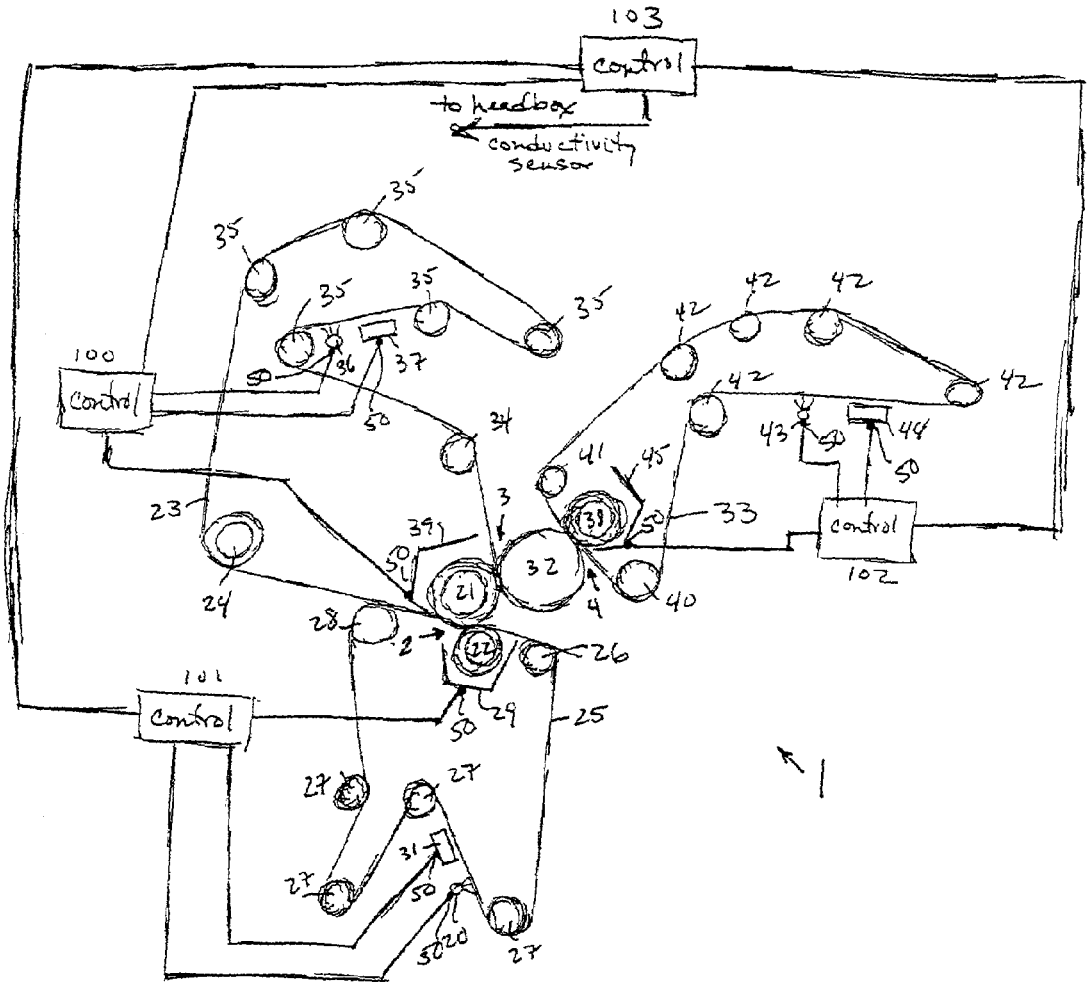
FIG. 1 illustrates a press section in the wet section of a web production machine in accordance with the features of the instant invention.

FIG. 1 illustrates a portion of a wet section in a web production machine, in particular, a press section 1. In particular, the press section includes a plurality of presses 2, 3, and 4 arranged to dewater the web. In particular, press 2 is formed by a pair of press rolls 21 and 22, which can be grooved, blind bored and/or suctioned. The web is picked up by a felt 23 as it is guided over a suction pick up roll 24 and transported toward press 2. In press 2, the web is sandwiched between felt 23 and another felt 25 so that water pressed out of the web can be absorbed by felts 23 and 25. Moreover, water removed in press 2 is collected in press pan 29. After press 2, the web and felt 23 separate from felt 25 so that the web and felt 23 are guided over press roll 21 to press 3, and felt 25 is deflected over a deflection roll 26 and guided, via a plurality of guide rolls 27 to a guide roll 28 positioned upstream of press 2. During the path in which it is guided from the exit of press 2 to guide roll 28, felt 25 is guided past a shower 20, arranged to clean/condition the felt, and a suction device 31, e.g., a Uhle box, arranged to remove excess water from felt 25. Conductivity sensors 50 are coupled to suction device 31, shower 20, and press pan 29.

Press 3 is formed by press rolls 21 and 32, and the web is guided through press 3 sandwiched between felt 23 and the surface of roll 32 so that water pressed out of the web can be absorbed by felt 23. Moreover, water removed in press 3 is collected in press pan 39. After press 3, felt 23 separates from the web, and the web is picked up by roll 32, which can have a smooth surface to facilitate the transfer of the web from felt 23. Felt 23 is deflected over a deflection roll 34 and guided, via a plurality of guide rolls 35 back to pick up roll 24. During the path in which it is guided from the exit of press 3 to pick up roll 24, felt 23 is guided past a shower 36, arranged to clean/condition the felt, and a suction device 37, e.g., a Uhle box, arranged to remove excess water from felt 23. Conductivity sensors 50 are coupled to suction device 37, shower 36, and press pan 39.

Press 4 is formed by press rolls 32 and 38, and the web is guided through press 4 sandwiched between the surface of roll 32 and a felt 33 so that water pressed out of the web can be absorbed by felt 33. Moreover, water removed in press 3 is collected in press pan 45. After press 4, the web is transferred to felt 33, and the web and felt 33 are guided to a deflection roll 40, where the web and felt 33 are separated. The web is guided to a downstream device for further processing, and felt 33 is deflected over deflection roll 40 and guided, via a plurality of guide rolls 42 to a deflection roll 41 arranged upstream of the inlet to press 4. During the path in which it is guided from the exit of press 4 to deflection roll 41, felt 33 is guided past a shower 43, arranged to clean/condition the felt, and a suction device 44, e.g., a Uhle box, arranged to remove excess water from felt 33. Conductivity sensors 50 are coupled to suction device 44, shower 43, and press pan 45.

Control unit 100 is coupled to receive information directed to the flow and conductivity of the water in press pan 39 and Uhle box 37. By analyzing the water balance as discussed above, a determination can be made with regard to actuating and/or adjusting shower 36 to clean felt 23, and with regard to adjusting the vacuum strength or slot sizes in Uhle box 37. Moreover, control unit 101 is coupled to receive information directed to the flow and conductivity of the water in press pan 29 and Uhle box 31, and control unit 102 is coupled to receive information directed to the flow and conductivity of the water in press pan 45 and Uhle box 44.

Further, a control unit 103 is coupled to control units 100, 101, and 102, as well as to a conductivity sensor in the headbox to compile the information for the press section.

In accordance with the features of the instant invention, the dewatering process can be monitored during operation of the web production machine. In this regard, the web consistency and dryness after the press are determined from the water balance of press section 1. In order to determine the water balance, the water flow rate (in gallons per minute (gpm)) into ($W_{in}$) and out of ($W_{out}$) press section 1 is measured, e.g., with flow meters, such as inductive flow meters, weir overflow boxes, etc., as is the conductivity into ($C_{in}$) and out of ($C_{out}$) the press section (in micro mhos (μ℧)). It is noted that weir overflow requires an accurate measurement of height, e.g., via a modification of notch to minimize sensitivity, correctly sized/designed collection boxes, resistivity vs. height, pressure vs. height, laser position measurement, ultrasonic position measurement, etc.

In measuring water flow into press section 1, the water of the wet web can be determined, e.g., by a gamma gauge and calculation, and the shower water utilized in press section 1 is measured. The water out of press section 1 is measured from water flow into Uhle boxes 31, 37, and 44 for each felt in press section 1, and from the press water collected in press pans 29, 39, and 45 of press section 1. The conductivity into press section 1 can be measured from the conductivity of the wet web, which is essentially the same as the headbox conductivity, and the conductivity of the shower water in showers 27, 36, and 43, which can be determined by, e.g., an in-line meter. The conductivity out of the press section is measured from the conductivity of the water collected in Uhle boxes 27, 37, and 44 and from the conductivity of the press water in press pans 39, 39, and 45, both of which can be determined by, e.g., an in-line meter. It is also noted that, in the event that suction rolls are utilized, water collected through this suction should be considered, and an estimate for uncollected spray could also be made.

With regard to the above-noted measurements, it is further noted that it may be advantageous to perform on-line felt scanning for the determination of moisture and permeability, as well as to actuate a cleaning process. Further, on-line sheet scanning can be performed by sensors embedded in the roll/sleeve/belt or by belt supported sheet/non-contacting sensors, and on-line nip monitoring can be performed by sensors embedded in the roll/sleeve/belt.

According to the present invention, conductivity versus dissolved solids is linear at paper making pHs, i.e., the absence of free mineral acidity or hydroxide alkalinity. As such, conductivity x flow is additive, i.e., a specific mixture of two different conductivities has only one possible conductivity. For example, 1 gallon at 500 μ℧+1 gallon at 1500 μ℧=2 gallons at 1000 μ℧.

Thus, utilizing the above-noted flow rates and conductivities, water flow ($W_{in}$)×conductivity ($C_{out}$) into the press section is determined, as is water flow ($W_{out}$)×conductivity ($C_{in}$) out of the press section. Moreover, these calculations can be made after each nip or press in the press section in order to better understand and optimize the process.

Accordingly, the instant invention utilizes the following balancing equations, whereby the exit sheet flow and exit sheet dryness are determined:

Calculated shower water in Uhle flow=Uhle flow× [(sheet conductivity−Uhle conductivity)/(sheet conductivity−shower conductivity)]; (1)

Calculated shower water in pan flow=Uhle flow× [(sheet conductivity−pan conductivity)/(sheet conductivity−shower conductivity)]; (2)

Sheet water in Uhle flow=Uhle box total−shower flow in Uhle box; (3)

Sheet flow in pan flow=pan total−shower flow in pan; (4)

Exit sheet flow (gpm)=(inlet sheet gpm+shower gpm)−(press pan+Uhle box) gpm−(shower measured gpm−shower calculated gpm); and (5)

Exit sheet dryness=inlet fiber mass/(exit mass of water+fiber). (6)

From the foregoing, it is noted that fiber mass is equal to the total dry mass, i.e., papermaking fiber and filler remaining after oven drying. The dry fiber entering the press section is known and the water entering the press section is measured, assumed, or estimated. It is preferable to measure the total mass of the web entering the press section, i.e., dry mass, water, and forming fabric, and then to calculate water flow rate. Once the first nip is calculated, it is used in the next nip calculation and so on.

Water content of the wet web is calculated from a nucleonic measurement of fiber, water, and forming fabric minus measured forming fabric minus the fiber weight which comes from the process control system. With an on-line determination of the nucleonic measurements and the process control fiber mass signal, the wet web water content can be calculated.

According to the instant invention, the exit sheet flow (consistency) and dryness can be determined, and this information can be utilized to optimize production performance. For example, press fabric dewatering can be optimized by monitoring the Uhle box water removal, whereby the vacuum strength and slot width can be adjusted, as necessary, and a determination of the age of the fabric and the shower/sheet water balance in the felt can be made. Further, press nip dewatering can be optimized by monitoring the water content of the felt, and monitoring changes in shower volumes.

Further, if the press section has an existing moisture measurement, then the water balance can be used to calculate couch solids. Moreover, if the after press solids change, then the water balance can pinpoint the cause of the change in performance. In this regard, changes in couch solids, nip dewatering rate, and Uhle box dewatering rate, and an analysis of why provides the opportunity for process optimization.

The present invention also enables optimization of sheet dewatering by monitoring the transfer of water to the press fabric, i.e., press fabric performance, and the transfer of water in the nip of the press rolls.

Figure 2:
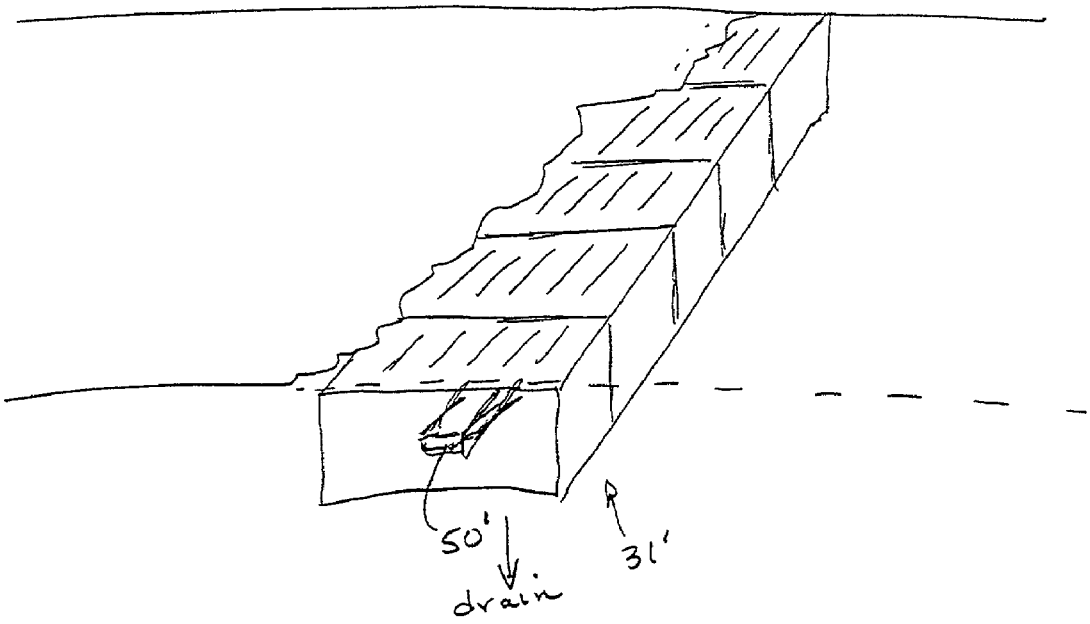
FIG. 2 illustrates an arrangement utilizing a sectioned Uhle box.

In accordance with another feature of the invention, the cross-direction water removal profile can be monitored. FIG. 2 illustrates a plan view of a Uhle box 31' that is sectioned in the cross-direction to divide the web into a plurality of sections, whereby the collected water is sectionally collected in the cross-direction. While any number of sections can be formed, it is preferred to form at least three sections, i.e., two edge sections having a width of at least about 1 m and a middle section including the remaining width of the web. However, more sections would provide a better indication of the cross-direction profile of water removal and enable better control over the optimization of the web production process. Moreover, this arrangement could also be provided by a plurality of appropriately sized Uhle boxes.

Figure 3:
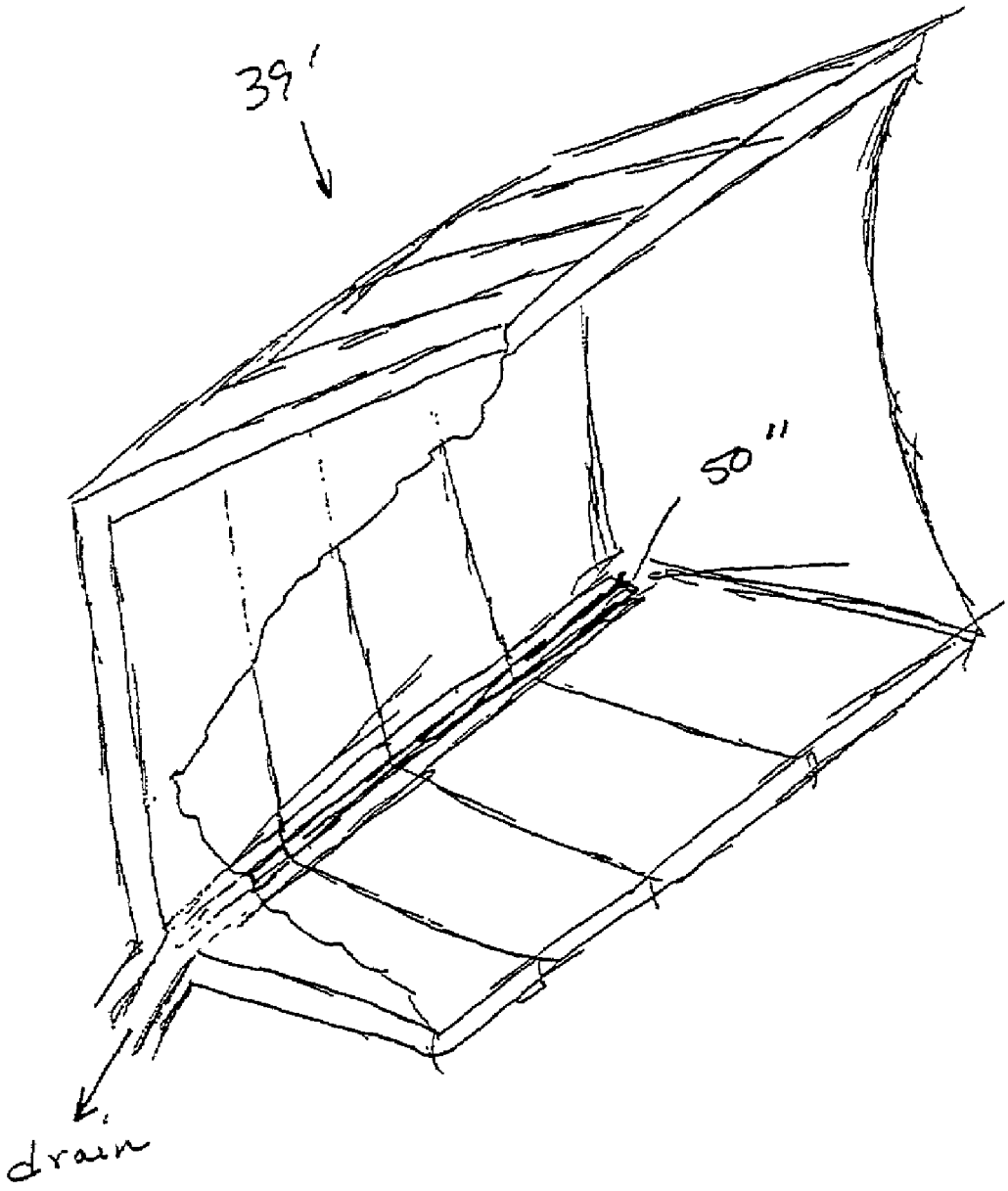
FIG. 3 illustrates an arrangement utilizing a sectioned press pan.

Additionally, or alternatively, a press pan 39' sectioned in the cross-direction could be provided, as illustrated in FIG. 3, to sectionally collect press water in the cross-direction. Like the above-noted Uhle box, it is preferable that press pan 39' is divided into at least 3 sections, but that additional sections provide the ability for enhance optimization of the production process.

A bank of cross-direction conductivity meters 50' and 50" are provided in sectioned Uhle box 31' and press pan 39', respectively. In this manner, conductivity variations in the cross-direction can be determined. By way of example, if shower water-removal is constant, the sheet/shower ratio variation across the fabric reflects the cross-direction sheet water removal by fabric. Moreover, if sheet water removal remains constant, the sheet/shower ratio variation reflects the cross-direction shower water application variation.

Moreover, in addition to sectionalized Uhle boxes and/or press pans, the apparatus can include sectionalized suction rolls to facilitate in the collection of water and to enhance the water removal cross-direction profile determination. Further, cross-direction sensor arrays can also be utilized for monitoring the sheet and felt.

Figure 2A:
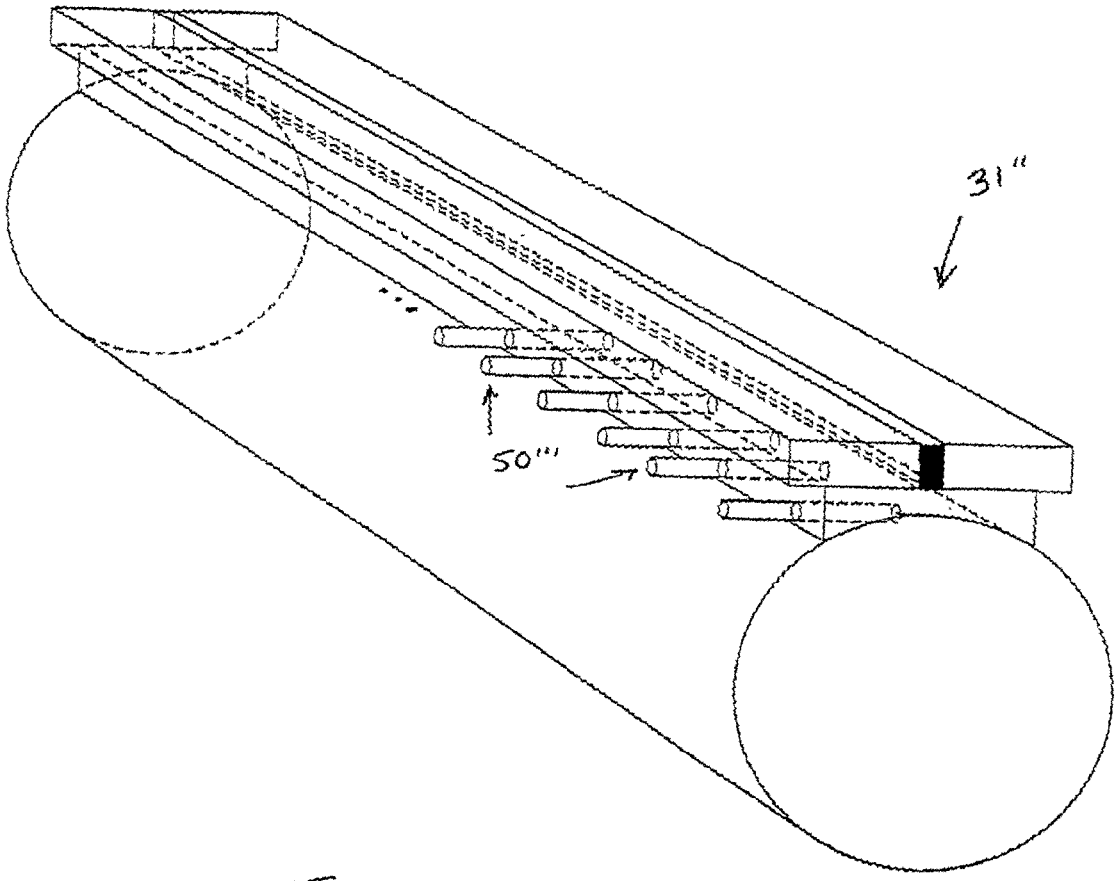
FIG. 2A illustrates an alternative Uhle box in accordance with the features of the instant invention.

Alternatively, or additionally, a Uhle box 31", as illustrated in FIG. 2A, can be utilized for water collection. In accordance with this embodiment, Uhle box 31" includes a plurality of conductivity sensors 50'" arranged to extend in the cross-direction in order to provide a sectional determination of conductivity in the cross-direction.

According to a further aspect of the instant invention, the cross-direction water removal profile can be utilized to condition the felt and/or indicate when replacement of the felt is necessary. In this regard, for a given grade of production, the largest variation in the press section is the condition of the press felts. For a given felt design, the performance of the felt changes over its lifetime, e.g., the removal of sheet water in a nip or press by a new felt may be merely a process of transferring the sheet water to the felt until removal at the Uhle boxes, however, as the felt ages, the total amount and proportion removed by the Uhle boxes generally decreases in a characteristic way. Thus, the sheet water removal cross-profile can be utilized to determine a rate of felt deterioration, thereby indicating that a chemical cleaning of the felt is required to improve the felt performance.

In this regard, referring back to FIG. 1, control unit 100 is coupled to receive information directed to the flow and conductivity of the water in press pan 39 and Uhle box 37. By analyzing the water balance as discussed above, a determination can be made with regard to actuating and/or adjusting shower 36 to clean felt 23, and with regard to adjusting the vacuum strength or slot sizes in Uhle box 37.

Moreover, it is preferable that Uhle box 37 and the press pan 39 be sectioned, as illustrated in FIGS. 2 and 3, so that the water balance analysis provides a cross-direction water removal profile of the felt. This information would then enable the user to sectionally adjust cleaning/suction parameters, thereby optimizing the dewatering performance of felt 23.

In a similar manner, control unit 101 is coupled to receive information directed to the flow and conductivity of the water in press pan 29, preferably formed as a sectioned press pan, and Uhle box 31, preferably formed as a sectioned Uhle box, and control unit 102 is coupled to receive information directed to the flow and conductivity of the water in press pan 45, preferably formed as a sectioned press pan, and Uhle box 44, preferably formed as a sectioned Uhle box. Again, by analyzing the water balance as discussed above, a determination can be made with regard to actuating and/or adjusting shower 36 to clean felt 23, preferably sectionally, and with regard to adjusting the vacuum strength or slot sizes in Uhle box 37, also preferably sectionally.

Through the above-noted felt control, the user is able to maintain stable dewatering conditions by keeping an optimal dewatering distribution and to maintain optimal runnability on a press section by reducing process variations. Moreover, it is noted that, as this control is based upon the existing vacuum system, significant cost savings are realized.

Moreover, as excessive sheet water removal can be an indication of excessive nip press, which can result in the unintended crushing of the sheet, the sheet water removal cross-profile can be utilized to indicate the need for cleaning the felt, reducing the nip loading, or reducing shower water flow, thereby preventing operational problems due to machine breaks.

Moreover, by analyzing the cross-directional water removal profile through the process and apparatus of the instant invention, many advantages are available to the user to optimize the web production process. For example, specific felt designs and multiple felt designs can be optimized. Further, it is possible to optimize the roll cover or sleeve hardness or venting. With regard to the felt, cleaning, shower flows, chemical cleaning or conditioning, applied vacuum can be optimized, as well as the Uhle box design. The instant invention also enables a felt startup strategy to minimize initial runnability problem, and the ability to identify key control variables, e.g., sheet/shower water ratio to optimize water removal.

After the press, a device can be arranged to measure the water weight of the web, e.g., the EnviroScan device. Moreover, such a device can be used in the water balance system, i.e., predicted sheet dryness can be compared to measured sheet dryness, and then used for calibrating the device, e.g., EnviroScan.

The cross-direction profile of sheet/shower water removal ratio in the Uhle box can be used to determine the cross-direction water removal in the felt or the distribution of shower water across the felt.

Therefore, the instant invention enables one to maintain an optimum compromise between quality issues such as bulk/dryness/bone dry weight and to maintain an optimum compromise between quality and productivity issues.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for monitoring dewatering in a wet end section of a web production machine, the process comprising:

measuring water flowing into the wet end section;

measuring water flowing out of the wet end section;

detecting conductivity of the wet web entering the wet end section;

measuring conductivity of the water flowing into wet end section;

measuring conductivity of water flowing out of the wet end section; and determining a water balance from the measured quantities, which is indicative of dewatering in the wet end.

2. The process in accordance with claim 1, wherein the water balance is determined from the equation:

water flow (Win)×conductivity (Cin)=water flow (Wout)×conductivity (Cout).

3. The process in accordance with claim 2, wherein the water balance is determined after each press in the wet section.

4. The process in accordance with claim 1, wherein the dewatering is monitored in a press section.

5. The process in accordance with claim 4, wherein the press section includes at least one press, at least one felt, at least one suction box, at least one shower nozzle; and at least one press pan, and the process further comprises:

collecting water pressed out in the at least one press in the at least one press pan;

collecting water from the at least one felt with the at least one suction box, wherein the collected water is water flowing out of the press section;

spraying the at least one felt with water from the at least one shower nozzle, wherein the sprayed water is water flowing into the press section; and determining the water balance of the press section, which is indicative of the dewatering in the press section.

6. The process in accordance with claim 5, wherein the water balance in the press section is determined by the equations:

Calculated shower water in Uhle flow=Uhle flow× [(sheet conductivity−Uhle conductivity)/(sheet conductivity−shower conductivity)]; (1)

Calculated shower water in pan flow=Uhle flow× [(sheet conductivity−pan conductivity)/(sheet conductivity−shower conductivity)]; (2)

Sheet water in Uhle flow=Uhle box total−shower flow in Uhle box; (3)

Sheet flow in pan flow=pan total−shower flow in pan; (4)

Exit sheet flow (gpm)=(inlet sheet gpm+shower gpm)−(press pan+Uhle box) gpm−(shower measured gpm−shower calculated gpm); and (5)

Exit sheet dryness=inlet fiber mass/(exit mass of water+fiber), (6)

wherein the Uhle flow and conductivity is from the water collected at least one suction box.

7. The process in accordance with claim 6, wherein the press section comprises a plurality of presses, and the water balance is determined after each press.

8. The process in accordance with claim 6, further comprising measuring the conductivity of the material suspension in the headbox as the conductivity of the web flowing into the press section.

9. The process in accordance with claim 5, wherein at least one of the collected water from the press pan and the collected water from the suction box is collected sectionally in the cross-direction.

10. The process in accordance with claim 9, wherein the conductivity of the at least one sectionally collected water is sectionally determined.

11. The process in accordance with claim 10, wherein the press section includes a plurality of presses, and the water balance is determined sectionally after each press to create a cross-direction water removal profile.

12. The process in accordance with claim 11, wherein the press section includes at least one control unit to monitor the cross-direction water removal profile and selectively adjust parameters to optimize felt life.

13. The process in accordance with claim 11, further comprising measuring the conductivity of the material suspension in the headbox as the conductivity of the web flowing into the press section.

14. The process in accordance with claim 13, wherein the conductivity and water flow of the web entering a subsequent press is calculated from the water balance.

15. The process in accordance with claim 9, wherein the collected water from the press pan and the collected water from the suction box are collected sectionally in the cross-direction, and the conductivity of the sectionally collected water is sectionally determined.

16. The process in accordance with claim 15, wherein a cross-direction profile of the sheet/shower water ratio in the at least one suction box is calculated to determine the cross-direction sheet water removal into the felt.

17. The process in accordance with claim 16, wherein the wet end section comprises a plurality of presses, and the water balance is determined after each press.

18. The process in accordance with claim 16, further comprising measuring the conductivity of the material suspension in the headbox as the conductivity of the web flowing into the wet end section.

19. The process in accordance with claim 18, wherein the collected water from the press pan and the collected water from the suction box are collected sectionally in the cross-direction, and the conductivity of the sectionally collected water is sectionally determined.

20. The process in accordance with claim 19, wherein a cross-direction profile of the sheet/shower water ratio in the at least one suction box is calculated to determine the cross-direction sheet water removal into the felt.

21. The process in accordance with claim 16, wherein at least one of the collected water from the press pan and the collected water from the suction box is collected sectionally in the cross-direction.

22. The process in accordance with claim 21, wherein the conductivity of the at least one sectionally collected water is sectionally determined.

23. The process in accordance with claim 22, wherein the wet end section includes a plurality of presses, and the water balance is determined sectionally after each press to create a cross-direction water removal profile.

24. The process in accordance with claim 23, wherein the wet end section includes at least one control unit to monitor the cross-direction water removal profile and selectively adjust parameters to optimize felt life.

25. The process in accordance with claim 24, wherein the selectively adjustable parameters include vacuum strength, suction box slot size, nip loading in the press, and shower flow.

26. The process in accordance with claim 23, further comprising measuring the conductivity of the material suspension in the headbox as the conductivity of the web flowing into the wet end section.

27. The process in accordance with claim 23, wherein the conductivity and water flow of the web entering a subsequent press is calculated from the water balance.

28. The process in accordance with claim 15, wherein the equation conductivity×water flow is additive.

29. The process in accordance with claim 9, further comprising supplying a suspension from a headbox to form the wet web, wherein the determined conductivity of the wet web entering the wet section corresponds to the conductivity of the suspension in the headbox.

30. The process in accordance with claim 1, wherein the water balance in the wet end section is determined by the equations:

Calculated shower water in Uhle flow=Uhle flow× [(sheet conductivity−Uhle conductivity)/(sheet conductivity−shower conductivity)]; (1)

Calculated shower water in pan flow=Uhle flow× [(sheet conductivity−pan conductivity)/(sheet conductivity−shower conductivity)]; (2)

Sheet water in Uhle flow=Uhle box total−shower flow in Uhle box; (3)

Sheet flow in pan flow=pan total−shower flow in pan; (4)

Exit sheet flow (gpm)=(inlet sheet gpm+shower gpm)−(press pan+Uhle box) gpm−(shower measured gpm−shower calculated gpm); and (5)

Exit sheet dryness=inlet fiber mass/(exit mass of water+fiber), (6)

wherein the Uhle flow and conductivity are determined from the water collected at the at least one suction box.

31. The process in accordance with claim 1, wherein, at papermaking pH, conductivity versus dissolved solids is linear.

32. The process in accordance with claim 1, further comprising supplying a suspension from a headbox to form the wet web, wherein the determined conductivity of the wet web entering the wet section corresponds to the conductivity of the suspension in the headbox.

33. The process in accordance with claim 1, wherein water content of the wet web is calculated from a nucleonic measurement of fiber, water, and forming fabric minus the measured forming fabric minus the fiber weight.

* * * * *